US007597418B2

(12) United States Patent
Mantell et al.

(10) Patent No.: US 7,597,418 B2
(45) Date of Patent: Oct. 6, 2009

(54) SYSTEM AND METHOD FOR ADJUSTING INK JET UNIFORMITY BASED ON DROP MASS HISTORY

(75) Inventors: David Allen Mantell, Rochester, NY (US); Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 311 days.

(21) Appl. No.: 11/888,112

(22) Filed: Jul. 31, 2007

(65) Prior Publication Data

US 2009/0033691 A1 Feb. 5, 2009

(51) Int. Cl.
*B41J 29/393* (2006.01)

(52) U.S. Cl. ..... 347/19

(58) Field of Classification Search ..... 347/15, 347/43, 19; 358/1.2, 1.9, 504
See application file for complete search history.

(56) References Cited

U.S. PATENT DOCUMENTS 5,347,374 A 9/1994 Fuss et al.
5,434,672 A * 7/1995 McGuire ..... 358/296
5,521,620 A * 5/1996 Becerra et al. ..... 347/14
5,777,656 A 7/1998 Henderson
5,847,724 A 12/1998 Mantell
6,806,980 B2 10/2004 Xu et al.
7,023,578 B2 4/2006 Hayes et al.
2006/0098251 A1 5/2006 Eklund et al.
2006/0285134 A1 12/2006 Viturro et al.

* cited by examiner

*Primary Examiner*—Lamson D Nguyen
(74) *Attorney, Agent, or Firm*—Maginot, Moore & Beck, LLP

(57) ABSTRACT

A method for processing input document data uses a drop mass history for ink jets in a print head to adjust other document data processing. The method includes ejecting ink in a plurality of patterns onto an image substrate from a plurality of ink jets, each drop in a pattern corresponding to one drop mass history in a plurality of drop mass histories, identifying a relationship between drop masses for the drops in an ejected pattern and a reflectance parameter for the ejected pattern, measuring a reflectance value for each pattern ejected onto the image substrate, and identifying a drop mass value for each drop mass history in the plurality of drop mass histories, each drop mass value being identified from the measured reflectance value for each pattern and the identified relationships between the drop masses and the reflectance parameter for each pattern.

20 Claims, 4 Drawing Sheets

SYSTEM AND METHOD FOR ADJUSTING INK JET UNIFORMITY BASED ON DROP MASS HISTORY

TECHNICAL FIELD

This disclosure relates generally to ink jet adjustment systems and, more particularly, to ink jet adjustment systems that evaluate ink drop mass.

BACKGROUND

Many document generating systems convert document data into control signals that operate an ink ejecting print head in a printer, for example, to produce an image of a document with ink drops emitted from the print head. In some of these systems, an electronic version of a document from a personal computer (PC) or other type of computing system is used to produce the document on media, such as paper or film. In other systems, an electronic document is generated by scanning an original hard copy document with a light source to generate reflected light representative of the document. The light signals are converted into electrical signals that may be stored in an electronic memory. The document generating system typically includes an image processor that manipulates the electronic data representing a document to a processed form of the document that is used to produce the hard copy version of the document.

A print engine may be used to manage the subsystems that cooperate to generate a document on media. These subsystems include the image processor and the components that apply or transfer marking material, such as ink, to media to form a document. For example, a direct marking system may include a marking material source, a print head, an image substrate, and a fuser. The marking material source may be an ink cartridge or a solid ink subsystem. Solid ink subsystems have a loader in which sticks of solid ink are loaded and transported to an ink melter that heats the ink sticks to a melting point to generate liquid ink. The liquid ink is collected in a reservoir to supply the print head. Ink cartridge systems are supplied with ink stored in replaceable ink cartridges. When the ink supply within a cartridge is exhausted, the cartridge is removed and replaced with another cartridge.

The print head in a document generating system is typically comprised of a plurality of ink jet nozzles arranged in a matrix. The ink jet nozzles are coupled by capillaries to the ink supply. They also include piezoelectric elements that are selectively excited by electrical signals from the print engine to eject ink from the capillaries onto an image substrate. In some systems, the print head may be a single print head supported on a carriage so the print head traverses back and forth in a horizontal path across the face of the image substrate. In other systems, multiple print heads that remain stationary and cover a portion of the image substrate may be used. For example, four print heads, each one covering half the width of the image substrate, may be arranged in a two by two matrix opposite the image substrate. Some systems may have one or more print heads that cover the entire width of the image substrate. The print engine communicates with the image processor to convert the electronic data of the document into the electrical signals delivered to the ink nozzles of the print head or heads to reproduce the electronic document on the image substrate.

Prior to generation of the electrical signals, the image processor typically filters or otherwise processes the electronic data for a document so the data are in a better form to generate the electrical signals for the driving the print heads.

For example, one or more tone reproduction curves (TRCs) may be used to map the input document data from an image gray scale to the gray scale that corresponds to the half tones produced by the print heads. These TRCs are generated by causing the print heads to print a plurality of test half tone patterns. These printed test patterns may be scanned by a sensor array in the document generating system or by an external scanner to evaluate the amount of ink ejected by the print heads. These data provide an indication of the amount of ink ejected by a print head in response to input data corresponding to a uniform gray scale. If the print head produces a darker gray scale than the input data, the input gray scale value is correlated to another gray scale value that results in an output pixel having a grayscale value that corresponds to the original pixel data. The input gray scale value and its correlated value form a datum point on a graph of input versus output grayscale values. A collection of these datum points over a grayscale range forms a TRC. A look up table may be constructed that uses input pixel data as addresses with the correlated gray scale value stored at the address. Using the look up table, input pixel data are mapped to the correlated gray scale values that are used to generate the electrical signals for the print head that produce a document image that corresponds more closely to the input document data.

Another type of input image data processing is error diffusion. In this type of image processing, an image data conversion process includes an error correction factor. For example, a scanned document may produce color data in the red, blue, and green (RGB) system. These data may be converted into a luminance system for generation of image data in the CMYK color space. The image generated on the media using the CMYK data may be evaluated to identify an error between the input data and the resulting color image. The error in a region may be diffused across the region by adjusting the luminance conversion with an error correction factor. Such error diffusion processing methods are known.

The various input image processing methods are intended to map the input-data to data that generate electrical signals for the print head or heads so they eject ink in a manner that better reproduces the electronic version of the document. The processing applied to the image data may even differ between text data and image data or halftone and color data. While these methods improve the correspondence of the output document to the input document, the document generating system components have differences that may require different adjustments. For example, different TRCs may be generated for different print heads because one print head ejects more ink than necessary for a particular gray scale while another print head may print less than needed for the same gray scale. Even within a print head, the piezoelectric elements may vary in their response to the same electrical signal. The different responses of the ink jet nozzles may cause gradients in the output document that are detectable by the human eye.

The variances in the responses of the ink jets impose a significant computational burden on the document data processing. If a TRC, for example, was developed for each ink jet nozzle, application of a different TRC to the pixel data generated for each nozzle requires a substantial number of look up table operations as TRCs are frequently implemented with look up tables. Even if this type of computational overhead could be handled, it would be exacerbated by the variations in the response of a single ink jet. The piezoelectric element in an ink jet nozzle ages over the life of the ink jet printing device. This aging may cause the piezoelectric element to eject less or more ink than it did at the start of its life. Periodic calibration may be able to adjust a TRC or error correction factor to counter this effect of component aging.

Another source of variance that is more problematic is the change in the drop mass ejected by an ink jet as the firing pattern of the jet changes. For example, an ink jet ejector may eject an ink mass if it has fired on the previous ejection cycle that is different from the ink mass if it has not fired on the previous ejection cycle. The drop mass may further depend on whether a drop was ejected on the cycles occurring before the previous ejection cycle. These variances in ink jet nozzle responses make document data processing more difficult, yet compensation for these differences is desirable.

SUMMARY

A method of processing document data has been developed that uses a drop mass history for ink jets in a print head to adjust other document data processing. The method includes ejecting ink in a plurality of patterns onto an image substrate from a plurality of ink jets, each drop in a pattern corresponding to one drop mass history in a plurality of drop mass histories, identifying a relationship between drop masses for the drops in an ejected pattern and a reflectance parameter for the ejected pattern, measuring a reflectance value for each pattern ejected onto the image substrate, and identifying a drop mass value for each drop mass history in the plurality of drop mass histories, each drop mass value being identified from the measured reflectance value for each pattern and the identified relationships between the drop masses and the reflectance parameter for each pattern.

The method may be implemented with a system that adjusts data used to process document data before print head firing signals are generated. The system includes a test pattern generator for generating test pattern data, each pixel in the test pattern data corresponding to one drop mass history in a plurality of drop mass histories, a print engine for converting the test pattern data into output image data for firing ink jets in a print head, a reflectance measurement circuit configured to measure reflected light from an image substrate onto which a test pattern has been ejected, a drop mass history identifier for identifying relationships for each drop mass history in a test pattern and for receiving reflectance measurements from the reflectance measurement circuit, and a mapping correction circuit configured to generate a compensation factor from the drop mass history relationships for the drop mass histories in the test patterns and the reflectance measurements.

BRIEF DESCRIPTION OF THE DRAWINGS

The foregoing aspects and other features of a method and system in which the drop mass history of ink jets in a print head is used to adjust document data processing are explained in the following description, taken in connection with the accompanying drawings, wherein.

DETAILED DESCRIPTION

An ink jet system may be used to print monochromatic or color images of documents that have been received from an image output device or a document generator. Document generators include personal computers, scanners, and workstations. The document generator provides input document data produced by application programs or the reception of light signals reflected from a hard copy of a document. These document data are typically processed before they are used to generate the control signals that operate the system components to produce a document. Because the components have particular physical characteristics that vary from ink jet device to ink jet device, some of the document data processing is performed to map the input document data to a form that corresponds to the physical characteristics of the components in a particular ink jet device. For example, a monochromatic version of a document may include pixels having a gray scale value in the range of 0 to 255. In this range, a zero value indicates no colorant is ejected for the pixel and the 255 value indicates the largest mass of colorant produced by an ink jet is ejected for the pixel. The actual ink jet printer components, such as the print head and its associated control circuits, may eject an amount of ink in response to the gray scale value for an input pixel that actually provides an output pixel that presents a different gray scale appearance to a human observer. Thus, the input document data processing includes a mapping of the input document data to device dependent values that cause the ink jet printing components to eject an amount of ink that more closely corresponds to the gray scale value of the input pixel.

Figure 1:
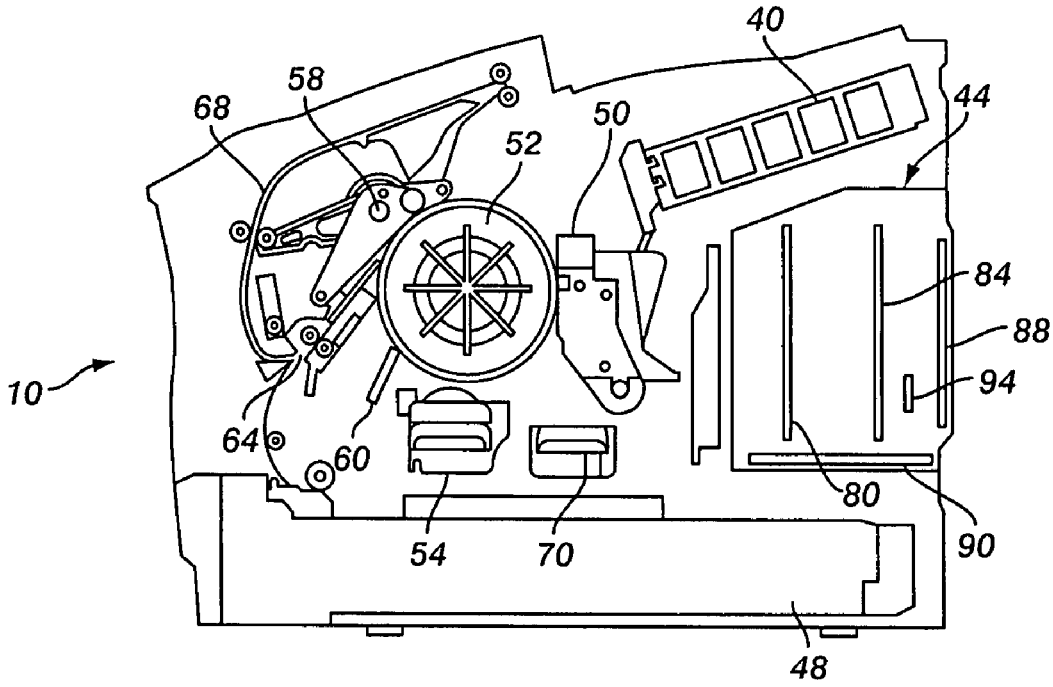
FIG. 1 PRIOR ART
FIG. 1 is a side view of an ink jet printing system that forms images of documents on a rotating intermediate image member.

Referring to FIG. 1, a side view is shown of a prior art ink printer 10 that may be modified to implement drop mass history adjustment of ink jets in a print head. The reader should understand that the embodiment of the print process discussed below may be implemented in many alternate forms and variations. In addition, any suitable size, shape or type of elements or materials may be used. As shown in FIG. 1, the ink printer 10 may include an ink loader 40, an electronics module 44, a paper/media tray 48, a print head 50, an intermediate imaging member 52, a drum maintenance subsystem 54, a transfix subsystem 58, a wiper subassembly 60, a paper/media preheater 64, a duplex print path 68, and an ink waste tray 70. In brief, solid ink sticks are loaded into ink loader 40 through which they travel to a melt plate (not shown). At the melt plate, the ink stick is melted and the liquid ink is diverted to a reservoir in the print head 50. The ink is ejected by piezoelectric elements to form an image on the intermediate imaging member 52 as the member rotates. Member 52 is called an intermediate imaging member because an ink image is formed on the member and then transferred to media in the transfix subsystem.

An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfix roller in the transfer subsystem 58 and the intermediate image member 52 is coordinated for the transfer of the image from the imaging member to the sheet of recording media.

Figure 2:
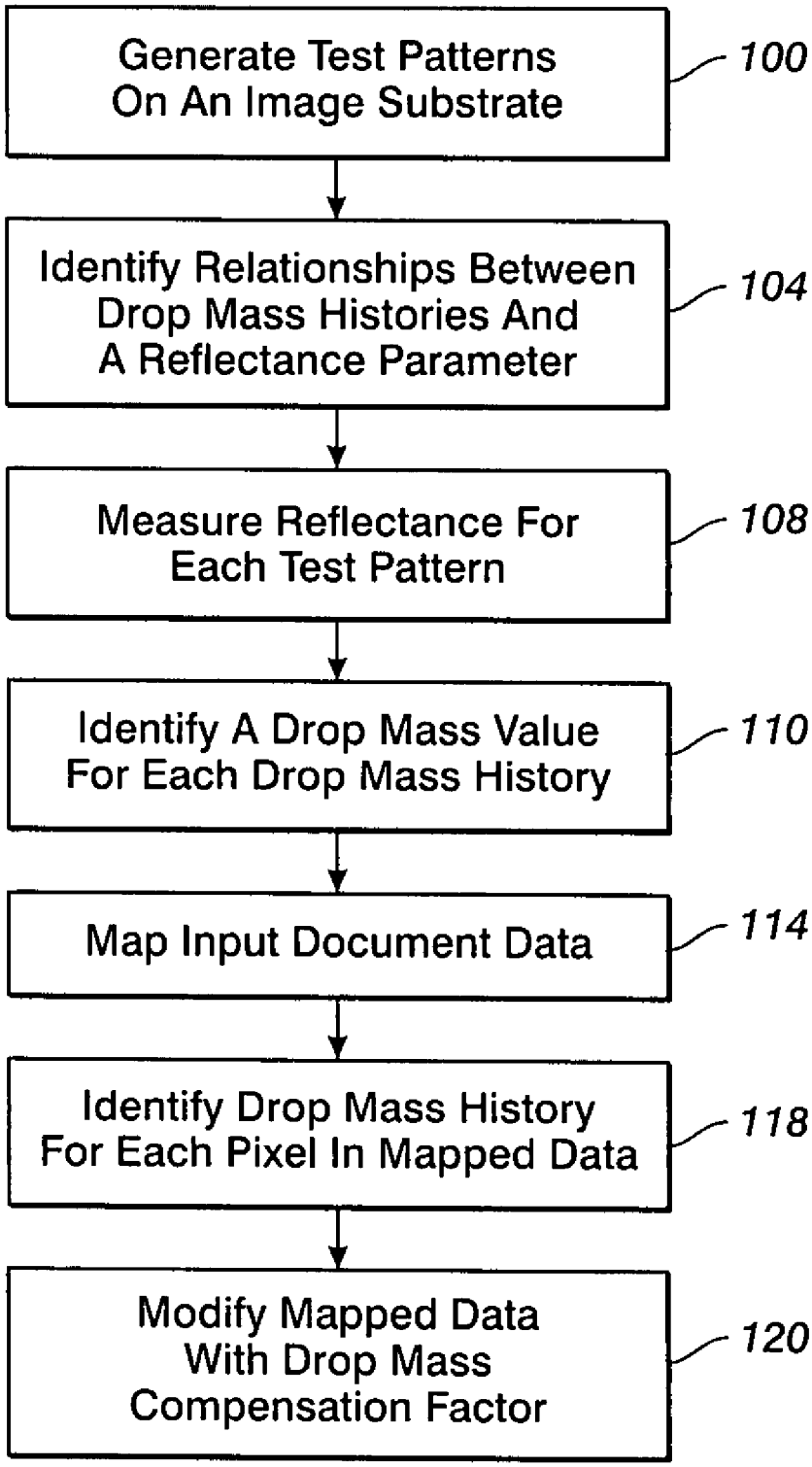
FIG. 2 is a flow diagram of a process for adjusting document data to compensate for drop mass history effects on ink jet ejection.

As noted above, the ink jets of a print head may be printer components that not only vary from print head to print head, but they also vary with the frequency with which they are fired. To compensate for the variation in the amount of ink ejected by an ink jet in response to its firing history, a method has been developed that modifies the other input document data processing with a drop mass history for the ink jets in a print head. The method is shown in FIG. 2 and begins by ejecting ink in a plurality of patterns onto an image substrate from a plurality of ink jets (block 100). Each drop in a pattern corresponds to one drop mass history in a plurality of drop mass histories.

Figure 3:
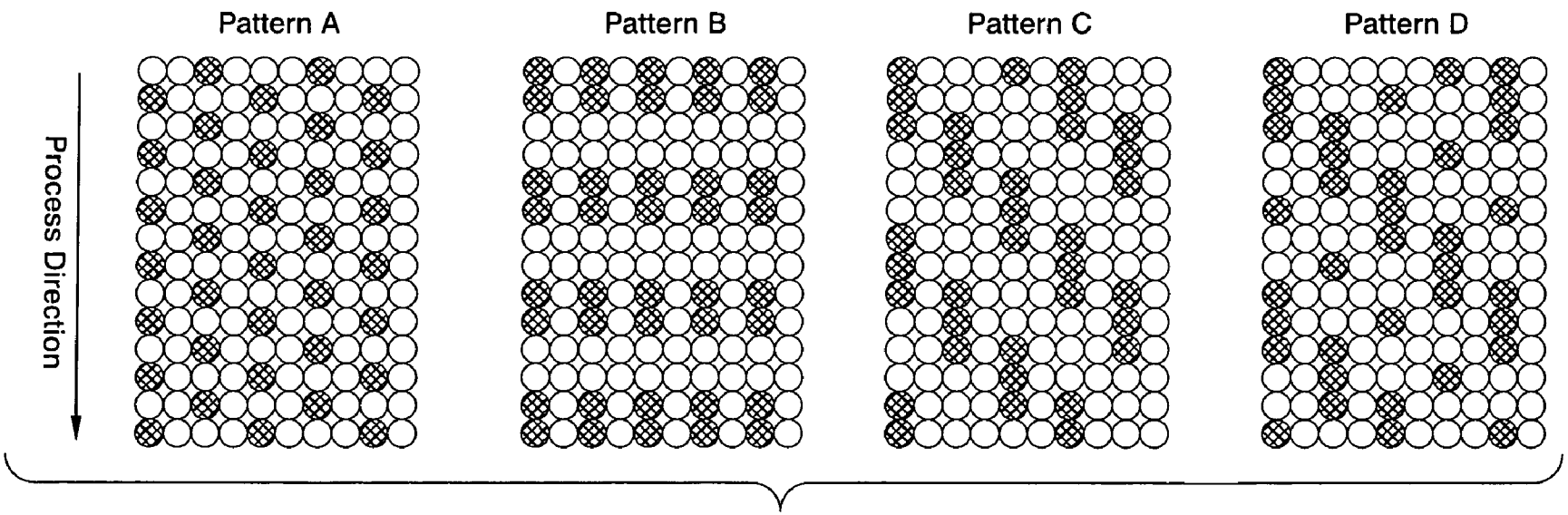
FIG. 3 is a diagram of four exemplary test patterns used to measure drop mass history effect on ink jet ejection.

Four exemplary halftone patterns that may be ejected by ink jet nozzles in a print head are shown in FIG. 3. Pattern A is generated by firing the odd-numbered jets, numbered from left to right, in an alternating sequence. Pattern B is generated by firing the odd-numbered ink jets twice, then waiting two cycles, and repeating the two on and two off sequence until the pattern is complete. Pattern C is generated by firing the odd-numbered ink jets three times, then waiting three cycles, and repeating the three on and three off sequence until the pattern is complete. Pattern D is formed by ejecting ink from the odd-numbered jets for three cycles, waiting two, firing once, waiting two and then repeating the sequence until the pattern is complete. These patterns may also be generated for the even-numbered jets by not ejecting ink from the odd-numbered jets and operating the even numbered jets in the manner described above for the various patterns.

The exemplary patterns have a twenty-five percent (25%) coverage area, which means twenty-five percent of the pixels in the pattern have an ink drop ejected for them. The coverage area is sometimes called the dither of a pattern. Different dither patterns may be used to develop drop mass histories for an ink jet printing device. The patterns shown in FIG. 3 are truncated so the twenty-five percent coverage is made with reference to a complete cycle of the firing sequence for a jet and the adjacent pixel positions in the inactive jet column. For example, seven of the fourteen pixel positions in the leftmost column of pattern A depict a drop while the adjacent column does not have any drops. Thus, seven of twenty-eight pixel positions are covered with ink. To evaluate coverage in pattern B, the two leftmost columns are truncated at the last two off position or extended to include the next two off so a completed sequence is evaluated. Thus, the two leftmost columns in pattern B, after three repetitions of the two on/two off sequence, provide ink in six of the twenty-four pixel positions. Similarly, after two repetitions of the three on/three off sequence in pattern C, ink has been ejected in six of twenty-four positions. In pattern D, the three on/two off/one on/two off sequence is performed completely only once in the leftmost column. Therefore, ink is provided in four of the sixteen pixel positions of the two leftmost columns. Each of these ratios provides a twenty-five percent coverage area over an area having complete repetitions of the firing sequence. While this description explains the twenty-five percent area coverage over the small portion of the test pattern presented in the figure, the actual test pattern printed is so large that complete repetitions of the firing sequence are not required to approximate the described area coverage. Equivalent patterns shifted by one pixel may be used to evaluate the jets that printed the inactive columns in the patterns of FIG. 3, if these jets are different than the ones that printed the patterns of FIG. 3.

A reflectance parameter may be associated with each pattern. Reflectance is the amount of light reflected by an image substrate onto which ink has been ejected. The image substrate may either be a media sheet, such as paper, or an intermediate image member, such as a print drum or belt. Some direct marking machines eject ink directly onto media sheets as they travel past one or more print heads in the machine. In other direct marking machines, the ink is ejected onto an intermediate image member, such as a rotating drum or belt, to form an image. The image is later transferred to media by synchronizing the passage of a media sheet through a transfix nip with the ink image passing through the same nip. A document image may be formed in a single pass or in multiple passes past the print head or heads. In machines having intermediate image members, multiple images may be formed on the image member surface. The areas between images are sometimes called an inter-document area and test patterns are frequently ejected onto these areas so printing characteristics may be evaluated during printing operations. An intermediate member or sheet surface without any ink is relatively smooth. Consequently, light directed towards the surface is almost completely reflected. As ink is applied to the image substrate surface, light directed towards the surface is absorbed by the ink and the amount of reflected light is attenuated. The amount of reflected light is sometimes called a reflectance parameter.

The reflectance parameter may be measured using a variety of methods. In direct marking machines that eject ink onto media sheets, the sheets onto which test patterns have been printed may be scanned by a moving light source and the amount of reflected light measured by a sensor. The sensor may include a plurality of photosensitive devices, such as charge coupled devices (CCDs), for example, that generate an electrical signal that corresponds to the amount of reflected light received the device. A linear array of photosensitive devices may be located at the Snell angle of reflectance from the light source to receive the reflected light. Because media sheets, such as paper, are typically diffuse surfaces, the array of photosensitive devices are positioned perpendicular to the media surface to detect light diffusely reflected from the inked or toned surface of the media sheets. In direct marking machines that eject ink onto a print drum or belt, the linear array is located at a fixed position proximate the drum or belt that is also oriented at the Snell angle with respect to a light source directed towards the image substrate. The photosensitive devices in the array detect light specularly reflected from the inked surface of the intermediate image member. This difference arises from the surface of an intermediate image member, such as a print drum or belt, being rough and highly structured. The signals from the photosensitive devices in the linear array may be summed to generate a reflectance parameter corresponding to a test pattern printed on the intermediate image member.

As noted above, each of the test patterns have a twenty-five percent coverage area. While ink drop mass is measured in units that are different than reflectance, for small changes in mass, reflectance measurements can be scaled so they vary linearly with drop mass changes. Consequently, the drop mass for each pixel would be the same and the reflectance measurements would be expected to vary linearly with the drop mass changes. This theoretical situation does not actually exist for a number of reasons. One of the conditions affecting the drop mass of the pixels is the firing sequence of the ink jets. Observations have been made that demonstrate the drop mass of an ink drop ejected by an ink jet is a function of the firing history or sequence for the jet. That is, an ink drop mass ejected in a cycle following a cycle in which another ink drop was ejected has a drop mass that differs from the ink drop mass ejected following a cycle in which no ink drop was ejected. In the system and method described herein, these different ink drop masses may be defined in the following manner:

$m_1$ is a drop mass ejected after a jet has not fired for two or more cycles.

$m_2$ is a drop mass ejected after a jet has not fired for one cycle, but was fired on the cycle prior to the non-firing cycle.

$m_3$ is a drop mass ejected after a jet was fired in the preceding cycle, but was not fired on the cycle prior to the firing cycle.

$m_4$ is a drop mass ejected after a jet was fired for two or more cycles.

Thus, while all of the pixels in the patterns shown in FIG. 3 look the same, in reality, they differ from one another. For example, all of the pixels in pattern A have a $m_2$ drop mass size because each pixel is ejected after a jet was not fired for only one cycle. These drop masses differ from the pixels in patterns B, C, and D as pattern B is comprised of pixels having $m_1$ and $m_3$ drop masses, while patterns C and D are comprised of pixels having $m_1$, $m_3$, and $m_4$ drop masses. As used in this description, the $m_1$, $m_2$, $m_3$, and $m_4$ parameters are referenced as drop mass histories because the drop mass ejected corresponds to the history of the most recent ink jet firings. The above example describes a system in which the drop mass depends on the previous two firing cycles. Other systems are possible in which the drop mass depends primarily on the previous cycle only as well as systems in which the drop mass depends on more than the two previous cycles.

Referring again to FIG. 2, a relationship between drop masses for the drops in an ejected pattern and a reflectance parameter for the ejected pattern is also identified (block 104). With reference to the exemplary patterns shown in FIG. 3 and the drop mass definitions provided above, these relationships may be identified as follows:

Reflectance for pattern $A(R_a)=m_2/4$

Reflectance for pattern $B(R_b)=m_1/8+m_3/8$

Reflectance for pattern $C(R_c)=m_1/12+m_3/12+m^4/12$

Reflectance for pattern $D(R_d)=m_1/8+m_3/16+m_4/16$.

The reflectance parameter is identified as a sum of the ratio of the drops for each drop mass history in a single column. For example, the leftmost column in pattern A has drops of mass $m_2$ in eight of sixteen positions so the reflectance is $\frac{1}{2}(m_2)$. Similarly, in the three repetitions of the complete sequence of pattern B, the leftmost column has drops of mass $m_1$ in three of twelve positions and drops of mass $m_3$ in three of twelve positions. The coefficients for the drop masses in the reflectance relationship for the patterns C and D noted above may likewise be observed from the completed sequences in one column of each pattern shown in FIG. 3.

Again with reference to FIG. 2, a reflectance value for each pattern ejected onto the image substrate is measured (block 108). The reflectance value may be measured as described above. The measured reflectance values are used with the identified reflectance relationships to identify a drop mass value for each drop mass history in the plurality of drop mass histories (block 110). The drop mass values may be identified by using the relationships for the exemplary patterns in a matrix equation. For example, the relationships set out above may be related in the following equation:

$$\begin{pmatrix} R_A \\ R_B \\ R_C \\ R_D \end{pmatrix} = \begin{pmatrix} 0 & 1/4 & 0 & 0 \\ 1/8 & 0 & 1/8 & 0 \\ 1/12 & 0 & 1/12 & 1/12 \\ 1/8 & 0 & 1/16 & 1/16 \end{pmatrix} \begin{pmatrix} m_1 \\ m_2 \\ m_3 \\ m_4 \end{pmatrix}$$

which can be solved for the drop masses to give:

$$\begin{pmatrix} m_1 \\ m_2 \\ m_3 \\ m_4 \end{pmatrix} = \begin{pmatrix} 0 & 0 & -12 & 16 \\ 4 & 0 & 0 & 0 \\ 0 & 8 & 12 & -16 \\ 0 & -8 & 12 & 0 \end{pmatrix} \begin{pmatrix} R_A \\ R_B \\ R_C \\ R_D \end{pmatrix}$$

This equation may be used to keep the drop mass histories constant. That is, the ejection of ink in subsequent test patterns and any reflectance parameter changes may be used to identify the amount and direction of a drop mass history change, which can then be used to generate a correction factor. The correction factor is used to modify the input document data processing.

When measuring the reflectance of patterns, such as those shown in FIG. 3, a complication may arise in determining the drop mass. The reflectance signal may depend on the amount of drop overlap as well as the mass of the drops. Consequently, printing is preferably performed at a speed that is high enough to reduce drop overlap. Printing in this manner helps ensure the reflectance represents the area covered by the isolated drops and that area relates directly to the mass of the drops. Alternatively, a pattern may be printed at a lower speed so the drops form a uniform layer. The reflectance of this layer can be directly related to the printed drop mass. If printing cannot be performed at one of these speeds, printing may be performed at multiple process speeds and the reflectance measurements compared to one another to estimate the contribution of overlap. These estimates may be used to extrapolate drop mass for isolated pixels.

Again with reference to FIG. 2, the method includes mapping pixels of input document data to generate output document data (block 114). This processing is known input document data processing, such as processing of input document data with data implementing tone reproduction curves (TRCs) or error diffusion processing to spread gray scale error around pixels in a neighboring region of the error. This type of processing is modified by identifying a drop mass history for each pixel in the input document data (block 118), and modifying pixels in the output document data in accordance with the identified drop mass value corresponding to the drop mass history identified for a pixel (block 120).

In another embodiment, the pixel mapping may include applying tone reproduction curve (TRC) data to the input document data to generate the output document data. The output document data resulting from this mapping may then be processed to identify the drop mass history for each pixel in the output document data. That is, the process identifies whether a pixel was ejected in a sequence corresponding to one of the drop mass histories, $m_1$, $m_2$, $m_3$, and $m_4$. The drop mass corresponding with the identified drop mass history is then compared to the output document data pixel to evaluate whether the output data pixel requires further adjustment. For example, if an output pixel is identified as a $m_1$ drop mass history because the ink jet did not eject ink during the two print cycles prior to the one for the output pixel, and the drop mass history $m_1$ corresponding to the gray scale for the output pixel is denser than the gray scale value for the output pixel data value, the output pixel gray scale value is downwardly adjusted. The new gray scale pixel value has an $m_1$ drop mass history that is approximately the same as the output pixel value prior to the drop mass history adjustment. Accordingly, the drop mass adjustment may be implemented as a look up table with the drop mass history number and the gray scale value of the output pixel being used as indices to select the adjusted gray scale pixel value.

Alternatively, the process of FIG. 2 may include generating TRC data that correspond to each drop mass history in the plurality of drop mass histories. The pixel mapping and modification of this alternative process further includes applying to each pixel in the input document data the TRC data that correspond to the drop mass history identified for the pixel. In this process, the TRC mapping incorporates the drop mass history adjustment. This method, however, requires storage of more TRCs than the method described above.

In another embodiment of the method of FIG. 2, the input document data are processed with an error diffusion methodology. In this process, a drop mass history is identified for each pixel in the input document data and an error correction factor is adjusted for the error diffusion process. The error correction factor corresponds with the drop mass value for the drop mass history identified for a pixel. The error diffusion process with the adjusted error correction factor is applied to the input document data to generate output document data.

Figure 4:
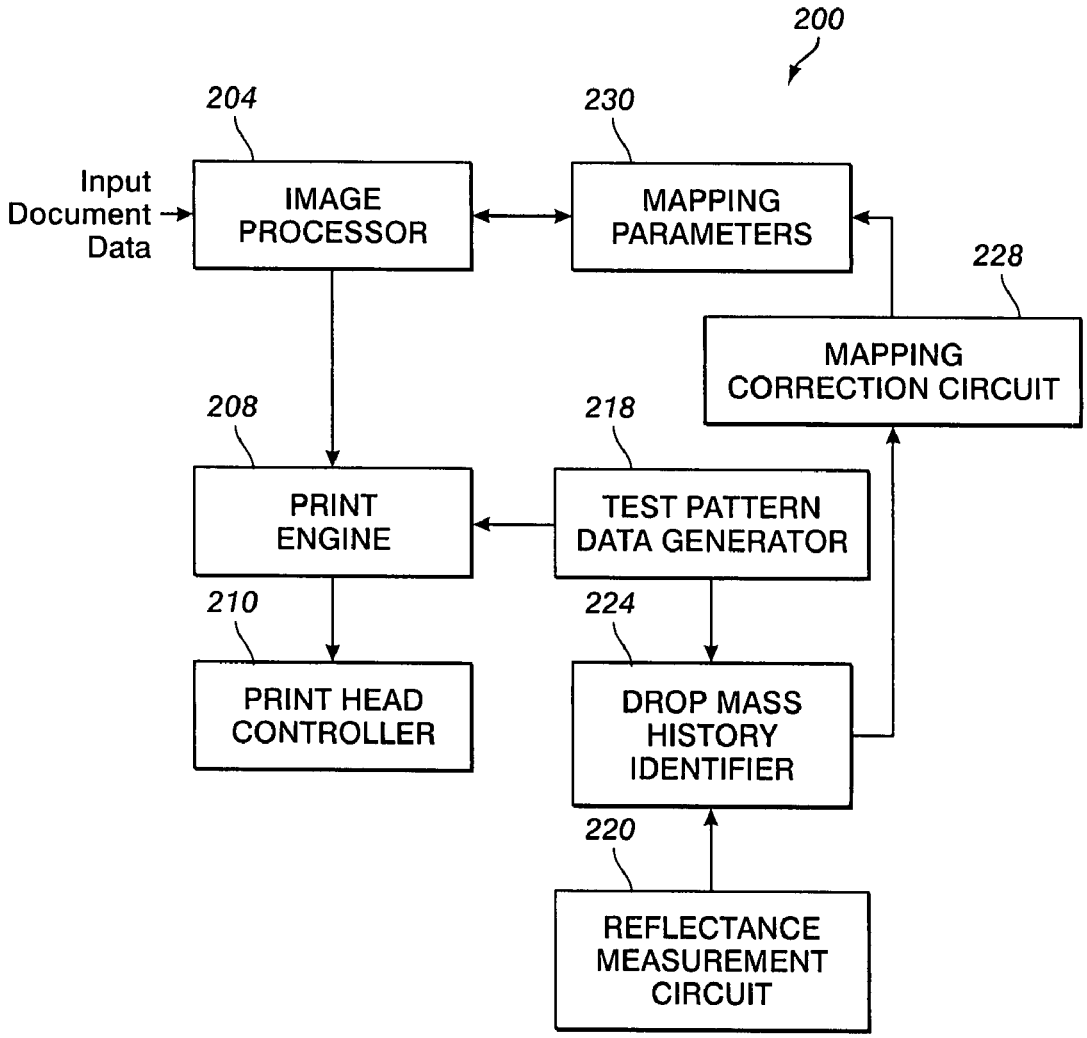
FIG. 4 is a block diagram of a system for implementing the process of FIG. 1.

A system for implementing the process described above is shown in FIG. 4. The system 200 includes an image processor 204, a print engine 208, and a print head controller 210. The image processor receives input document data from a scanner or document generator and applies mapping parameters from mapping parameters application circuit 214 to generate output document data. The mapping parameters application circuit 214 may include one or more look up tables that implement TRC mapping or a processor and associated programmed instructions and data implementing an error diffusion process. The output document data are provided to the print engine 208 for generation of ink jet driving data that are supplied to the print head controller 210. The print head controller 210 generates the ink jet driving signals that excite the piezoelectric elements in the print head to eject ink from the jets to form images on an image substrate.

The system 200 also includes a test pattern data generator 218 that generates data for forming test patterns, such as those depicted in FIG. 3. The pixels in the test pattern are data values that cause an ink jet to eject ink. These data are provided to the print engine 208 for the generation of ink jet driving data that are supplied to the print head controller 210. The print head controller 210 drives the ink jets to eject the test patterns onto the image substrate. A reflectance parameter for the test patterns on the image substrate is measured by the reflectance measurement circuit 220 and the reflectance values are provided to the drop mass history identifier 224. The reflectance measurement includes at least one light source to direct light towards an image substrate and an array of light sensors that generate electrical signals in response to the light reflected from the image substrate. The reflectance measurement circuit 220 may be, for example, a document scanner that scans a media sheet onto which a test pattern has been ejected. In another embodiment, the light source may be at least one light emitting diode (LED) that is mounted proximate to an intermediate image member and the light sensor is an array of CCDs positioned to receive light reflected from the image member. If a single LED is used, a light pipe may be provided to illuminate a strip across the image member. Alternatively, an array of LEDs may be provided for illumination of a strip across the image member.

The drop mass history identifier 224 receives the test pattern data and identifies the relationships between the test pattern pixels and the drop mass histories. The identifier 224 also builds the matrix relationships between the drop mass histories and the reflectance parameter values. The drop mass history identifier 224 may be configured to, identify relationships for each drop mass history in a test pattern with matrices of equations and to solve the matrices using reflectance measurements as a forcing vector. These relationships and values are provided to the mapping correction circuit 228. The mapping correction circuit is configured to generate a correction factor for the mapping parameter application circuit 230. As explained above, the correction factor may be a modification of a TRC, output document data, or generation of an error correction factor for an error diffusion process. The mapping parameter application circuit 230 is configured to apply mapping parameters to input document data and to adjust application of the mapping parameters with the compensation factor received from the mapping correction circuit 228.

The circuits described herein and the functions that they perform may be implemented with general or specialized programmable processors that execute programmed instructions. The instructions and data required to perform the programmed functions may be stored in memory associated with the processors. The processors, their memories, and interface circuitry may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and, others.

We claim:

1. A method for processing document data comprising:

ejecting ink in a plurality of patterns onto an image substrate from a plurality of ink jets, each drop in a pattern corresponding to one drop mass history in a plurality of drop mass histories;

identifying a relationship between drop masses for the drops in an ejected pattern and a reflectance parameter for the ejected pattern;

measuring a reflectance value for each pattern ejected onto the image substrate; and identifying a drop mass value for each drop mass history in the plurality of drop mass histories, each drop mass value being identified from the measured reflectance value for each pattern and the identified relationships between the drop masses and the reflectance parameter for each pattern.

2. The method of claim 1 further comprising:

mapping pixels of input document data to generate output document data;

identifying a drop mass history for each pixel in the input document data; and modifying pixels in the output document data in accordance with the identified drop mass value corresponding to the drop mass history identified for a pixel.

3. The method of claim 2, the pixel mapping comprising:

applying tone reproduction curve (TRC) data to the input document data to generate the output document data.

4. The method of claim 2 further comprising:

generating TRC data that corresponds to each drop mass history in the plurality of drop mass histories; and the pixel mapping and modification further comprising:

applying to each pixel in the input document data the TRC data that corresponds to the drop mass history identified for the pixel.

5. The method of claim 1 further comprising:

identifying a drop mass history for each pixel in document data;

adjusting an error correction factor for an error diffusion process with the drop mass value corresponding to the drop mass history identified for a pixel; and applying the error diffusion process with the adjusted error correction factor to the document data to generate output document data.

6. The method of claim 1, the ink ejection further comprising:

ejecting ink in a pattern onto a media sheet; and scanning the media sheet with the ink to measure the reflectance parameter for the pattern.

7. The method of claim 1, the ink ejection further comprising:

ejecting ink in a pattern onto an intermediate image member;

directing light towards the ink on the intermediate image member; and measuring an intensity of the light reflected from the intermediate image member.

8. A system for compensating for drop mass history on ink jet ejection comprising:

a test pattern generator for generating test pattern data, each pixel in the test pattern data corresponding to one drop mass history in a plurality of drop mass histories;

a print engine for converting the test pattern data into output image data for firing ink jets in a print head;

a reflectance measurement circuit configured to measure reflected light from an image substrate onto which a test pattern has been ejected;

a drop mass history identifier for identifying relationships for each drop mass history in a test pattern and for receiving reflectance measurements from the reflectance measurement circuit; and a mapping correction circuit configured to generate a compensation factor from the drop mass history relationships for the drop mass histories in the test patterns and the reflectance measurements.

9. The system of claim 8 further comprising:

a mapping parameter application circuit being configured to apply mapping parameters to input document data and to adjust application of the mapping parameters with the compensation factor received from the mapping correction circuit.

10. The system of claim 9, the mapping parameter application circuit being configured to apply tone reproduction curve (TRC) data to the input document data and to adjust data for at least one TRC that corresponds to the drop mass history for a compensation factor.

11. The system of claim 9, the mapping parameter application circuit being configured to adjust with the compensation factor input document data to which TRC data has been applied.

12. The system of claim 9, the mapping parameter application circuit being configured to process input document data with an error diffusion method and to adjust an error factor with the compensation factor.

13. The system of claim 8, the test pattern generator being configured to generate test patterns having a single dither formed from pixels of a single drop mass history.

14. The system of claim 8, the test pattern generator being configured to generate test patterns having a single dither formed from pixels of at least two drop mass histories.

15. The system of claim 8, the reflectance measurement circuit having at least one light source to direct light towards an image substrate and a light sensor that generates electrical signals in response to light reflected from the image substrate.

16. The system of claim 15, the reflectance measurement circuit being a scanner for scanning a media sheet onto which a test pattern has been ejected.

17. The system of claim 15, the light source being at least one light emitting diode mounted proximate to an intermediate image member; and the light sensor being an array of photosensitive devices positioned to receive reflected light from the intermediate image member.

18. The system of claim 8, the drop mass history identifier being configured to identify relationships for each drop mass history in a test pattern with matrices of equations and to solve the matrices using the reflectance measurements as a forcing vector.

19. The system of claim 8, the ink ejected by the print head being stored in an ink cartridge.

20. The system of claim 8, the ink ejected by the print head being melted ink.

* * * * *